US005273278A

United States Patent [19]

Becker

[11] Patent Number: 5,273,278

[45] Date of Patent: Dec. 28, 1993

[54] SPORTS IMPLEMENT WITH AUDIO FEEDBACK

[76] Inventor: Roland Becker, P.O. Box 6858, Tahoe City, Calif. 95730

[21] Appl. No.: 650,557

[22] Filed: Feb. 1, 1991

[30] Foreign Application Priority Data

Feb. 2, 1990 [AU] Australia ..... PJ8420

[51] Int. Cl.[5] ..... A63B 69/40

[52] U.S. Cl. ..... 273/29 A; 273/26 B; 273/35 R

[58] Field of Search ..... 273/67; 272/116, 94, 272/143; 446/266

[56] References Cited

U.S. PATENT DOCUMENTS

| | | | |
|---|---|---|---|
| 805,132 | 11/1905 | Gubbins | 273/72 R |
| 838,257 | 12/1906 | Kinst . | |
| 1,519,052 | 12/1924 | Reach . | |
| 1,549,350 | 8/1925 | Deike . | |
| 2,159,579 | 5/1939 | Whitney . | |
| 2,608,409 | 8/1952 | Pinkerton | 273/26 B |
| 2,838,312 | 6/1958 | Drake . | |
| 2,950,115 | 8/1960 | Hurdzan . | |
| 2,984,486 | 5/1961 | Jones | 273/72 R |
| 3,463,492 | 8/1969 | White | 273/26 B |
| 3,469,839 | 9/1969 | Pietronuto et al. | 273/72 R |
| 3,575,419 | 4/1971 | Davis . | |
| 3,618,945 | 11/1971 | Kucher | 273/26 B |
| 3,623,724 | 11/1971 | Lande | 273/72 R |
| 4,200,285 | 4/1980 | Petitti | 273/29 A |
| 4,222,562 | 9/1980 | Gardner | 273/67 R |
| 4,283,057 | 8/1981 | Ragan . | |
| 4,416,451 | 11/1983 | Solloway | 273/26 B |
| 4,521,011 | 6/1985 | Solloway | 272/116 |
| 4,907,800 | 3/1990 | Passamaneck | 273/26 B |
| 5,002,275 | 3/1991 | Beutler et al. | 273/26 B |
| 5,058,890 | 10/1991 | Szabo | 273/26 R |

FOREIGN PATENT DOCUMENTS

| | | | |
|---|---|---|---|
| 1195408 | 11/1959 | France . | |
| 11175 | of 1889 | United Kingdom | 273/67 DC |

OTHER PUBLICATIONS

Washington Post, Jun. 13, 1973, p. E≧2.

*Primary Examiner*—Theatrice Brown

[57] ABSTRACT

A sports implement, such as a tennis racket, baseball bat or golf club, includes an audio feedback device to provide an audible indication of the speed of movement of the sports implement. The audio feedback device includes ridges and grooves formed along the length of one of the structural members of the sports implement, such as along the shaft of the golf club, along the length of the baseball bat, along the handle of the tennis racket, or along the lateral sections of the head of the tennis racket. The ridges and grooves are configured to provide an audible indication when the sports implement is being swung at a proper speed. The audio feedback device can be a separate tubular member which is mounted to a generally conventional sports implement or it can be created by appropriately configuring the surface of the sports implement.

9 Claims, 2 Drawing Sheets

SPORTS IMPLEMENT WITH AUDIO FEEDBACK

BACKGROUND OF THE INVENTION

This invention relates to an audio feedback device for use with sports implements and sports implements incorporating same.

The development of skill in games and sports involving striking of a ball with a racket, bat or club involves the improvement of the ability of a player to swing the sports implement at an optimum speed, which depends on the sport being played. It is particularly important to time the swing of the stroke such that the sports implement is travelling at the optimum speed when it actually makes contact with the ball being struck. These skills are not easily taught and it generally takes most players many hours of practice in order to perfect the swing arc and the speed at which the sports implement is swung. One reason why the skill is different to perfect is that with most sports the racket is moving at a considerable speed at the point of impact and accordingly it is not possible for the player to accurately determine by watching the movement of the sports implement whether or not the sports implement is being swung in the correct arc or at the correct speed. Since consistency of stroke is an important factor in most sports this perfection of the swing arc and stroke speed is an important aspect of the skill advancement.

SUMMARY OF THE INVENTION

It is an object of the present invention to provide a device and/or a sports implement which will assist players in improving their playing strokes.

The present invention is characterised in that it provides an audio device for fitting to or integrating into a sports implement, the audio device being in a form of a plurality of elongate ridges and/or grooves which, when the sports implement on which the audio device is located is swung through the air at optimum speed for that implement, air passing over the grooves and/or ridges will produce an audible sound which is reflective of the correctness or otherwise of the stroke being played. It is preferred that the device is of tubular form and that the grooves and/or ridges extend substantially parallel with the axes of the tubular member and extends substantially the entire way around the circumference of the tubular member.

It will be convenient to hereinafter describe example forms of the invention by reference to the attached drawings, but those drawings are not to be understood as illustrating the only possible forms of arrangements of the invention. Furthermore, the drawings illustrative audio feedback devices fitted to various sports implements but it is to be understood that those sports implements are not the only implements to which the devices can be fitted to or incorporated into.

DESCRIPTION OF THE PREFERRED EMBODIMENTS

Figure 1:
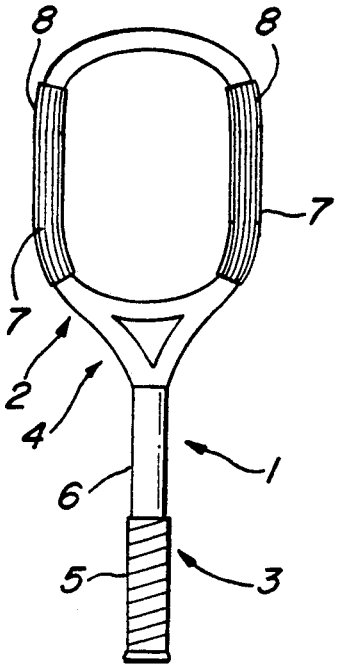
FIGS. 1 and 2 show an audio feedback device for a tennis racket.

As shown in FIG. 1 of the drawings, a tennis racket 1 has a head 2 and a handle 3 and the head is joined to the handle by a yoke 4, all components being of substantially standard configuration. The handle is provided with a grip 5 and an audio feedback device 6 is fitted to the handle between the grip 5 and the yoke 4. In addition, audio feedback devices 7 are located on the frame members 8 which comprise the sides of the head 2. It will be noted that the audio feedback devices extend substantially the entire length of the sides 8.

Figure 2:
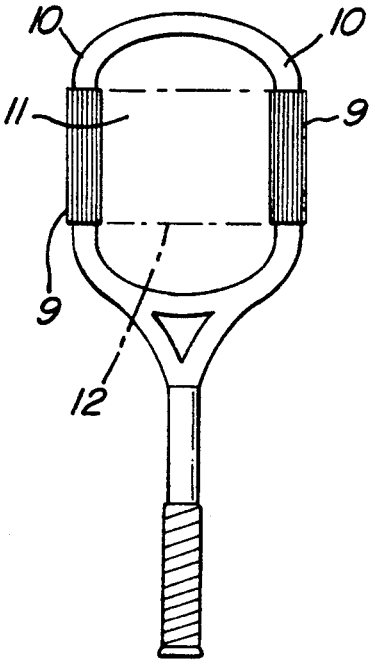

An alternative arrangement is shown in FIG. 2 of the drawings in which audio feedback devices 9 are once again fitted to the sides 10 of the racket head as shown but the audio feedback devices are far shorter than those depicted in the embodiment shown in FIG. 1. In the FIG. 2 arrangement, the audio feedback devices are located opposite a central zone 11, demarcated by dotted lines 12, and that central zone 11 will comprise the ideal hitting region or "sweet spot" as the zone is often referred to by tennis players. The audio feedback devices 9 will preferably be constructed from a material having a color which contrasts from the remainder of the racket such that the audio feedback devices will serve to demarcate the central zone 11 when those devices are located on the tennis racket as depicted in FIG. 2.

The actual form of the audio feedback devices as depicted in FIGS. 1 and 2 will be described in more detail herebelow.

Figure 3:
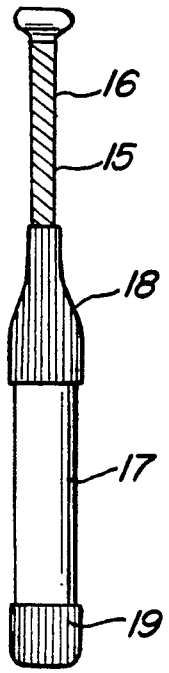
FIGS. 3 and 4 show an audio feedback device for a baseball bat.
Figure 4:
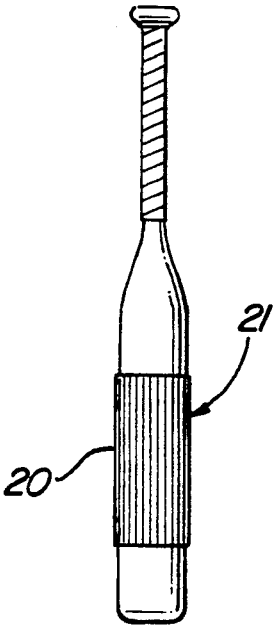

FIGS. 3 and 4 depict baseball bats wherein audio feedback devices have been fitted thereto or incorporated therein. As shown in FIG. 3, the bat 15 has a handle 16 and a hitting zone 17 towards the end of the bat remote from the handle 16. Two audio feedback devices 18 and 19 are fitted to the bat. Audio feedback device 18 is located between the handle 16 and the hitting zone 17 whilst feedback device 19 is located on the end of the bat remote from the handle. Thus, the hitting zone 17 has a substantially smooth surface whereas the two audio feedback devices 18 and 19 will provide a ribbed surface which will produce an audible sound when the bat is swung through the air in a stroke playing arc in use.

The bat shown in FIG. 4 has a single audio feedback device 20 fitted thereto, that device being located in the hitting zone 21. The audio feedback device 20 will thus demarcate the "sweet spot" of the bat. Clearly, the audio feedback device 20 will need to be made of a material which does not damage or deteriorate when used repeatedly to hit balls.

Figure 5:
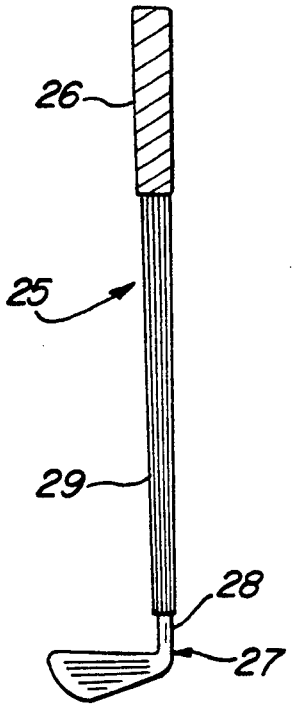
FIGS. 5 and 6 show an audio feedback device for a golf club.
Figure 6:
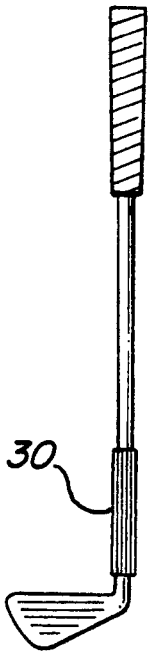

FIGS. 5 and 6 depict golf clubs with audio feedback devices fitted thereto. FIG. 5 depicts a club 25 having a handle 26 and a club head 27 with a shaft 28 connecting the handle 26 to the head 27. An audio feedback device 29 extends substantially the entire length of the shaft 28. The club shown in FIGS. 6, however, has only a short audio feedback device 30 fitted thereto which is preferably fitted near the head 31 of the club. This will be at the point of maximum velocity of the club when it is swung through a stroke playing arc and accordingly the relative speed between the club head and the air through which the club is swung will be at a maximum in this region.

It is envisaged that audio feedback devices according to the invention can be fitted to conventional sports implements without requiring those sports implements to be modified or adapted in any way.

Figure 7:
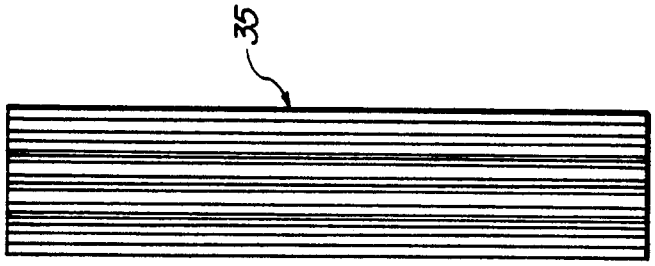
FIGS. 7 and 8 show the ridge profile for the audio feedback device of FIGS. 1 and 2.
Figure 8:
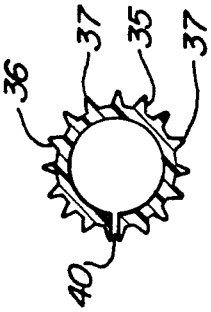

FIGS. 7 and 8 depict an audio feedback device 35 which could conveniently be fitted to rackets as shown in FIGS. 1 and 2. The audio feedback device 35 comprises a length of tubular material having an outer surface 36 which is defined by a series of ridges 37 which extend the length of the device 35 and are aligned parallel to the axis 38 of the tubular member. The ridges 37 are preferably triangular in cross-sectional form and the apex 39 of the triangular form is preferably relatively sharp pointed and may have an angle of approximately 20°. It is envisaged that the tubular member will have a diameter of between 12 and 25 mm and the length of the tubular member will be between 100 and 150 mm. A gap 40 is formed in the tubular member which extends the length thereof and that allows the tubular member to be opened in order that it can be fitted around the frame of a racket. It is envisaged that the tubular member will have a wall thickness of between 1 and 1.5 mm and the ridges will have height of between 1 and 1.5 mm and it will be spaced apart by between 1 and 1.5 mm. The resilience of the material will serve to clamp the device onto the frame in use.

Figure 9:
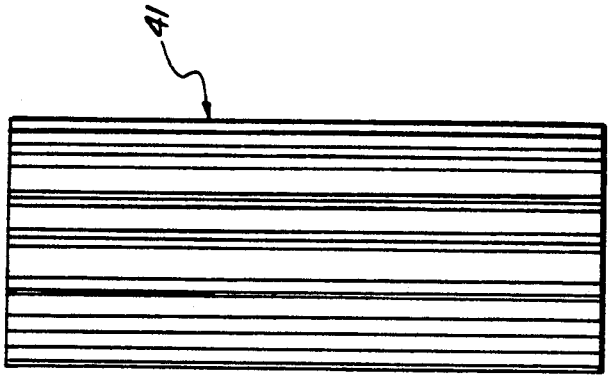
FIGS. 9 and 10 show the ridge profile for the audio feedback device of FIGS. 3 and 4.
Figure 10:
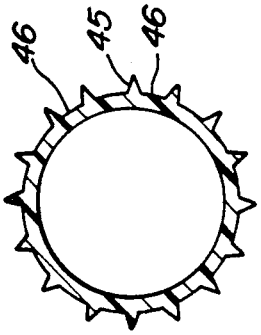

Referring now to FIGS. 9 and 10 of the drawings, an audio feedback device 41 suitable for fitting on to baseball bats and the like is shown. The ridges 45 of that device are also aligned with the longitudinal axis of the tubular member but they are of larger dimension than those shown in FIGS. 7 and 8. It is envisaged that the ridges will have a height of between 2 and 3 mm and will be spaced apart by lands 46 around the circumference of the tubular member at spacings of between 2 and 3 mm. The thickness of the tubular wall will preferably also be between 2 and 3 mm. The diameter of the tubular member will be between 50 and 85 mm and the length may conveniently be between 100 and 200 mm. Clearly, the dimensions of the tubular member will be selected in accordance with the bat to which it is to be applied to. The tubular member shown in FIG. 9 may be rolled onto the bat.

Figure 11:
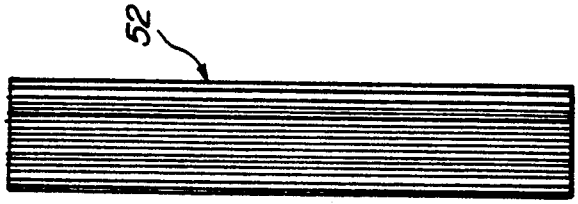
FIGS. 11 and 12 show the ridge profile for the audio feedback device of FIGS. 5 and 6.
Figure 12:
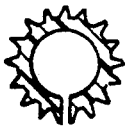

FIGS. 11 and 12 depict an audio feedback device 42 suitable for fitting to golf clubs and the like. The dimensions and configurations of the grooves and ridges on the device will be substantially the same as those depicted in FIGS. 7 and 8. However, the diameter of the tubular member will be between 10 and 15 mm.

In each case the material from which the tubular members are made is preferably an injection or extruded rubber or plastics material which is flexible but with a high memory. Clearly, it will be possible to attach the devices by using the resilience of the material itself. Alternatively, clamping means or adhesive means may be used to secure the tubular members in position on their respective sports implements. Other materials may be used to form the device.

It will be appreciated that it is not essential for the audio feedback devices to be made separate from the instrument. It is within the scope of this invention to mould or otherwise form the audio feedback devices as part of the sports implement and the devices will be so formed during the manufacture of the sports implement. Where the sports implement is manufactured using a moulding process, the necessary grooves and ridges can easily be formed during that moulding process. Alternatively, the sound producing formations can be cut into the sports implement after the forming of the implement.

One advantage of having the audio feedback device as a tubular member separate from the sports implement itself is that the ends of the audio feedback device can be twisted relative to each other about the tubular member axis to provide a helical form to the device. The sound produced by the device as the sports implement is swung through the air will be substantially reduced as a result of this twisted configuration and accordingly this twisting capability will provide an "on/off" feature for the device. If it is desired to reduce the sound made by the device a limited twist can be applied to the ends of the device which will reduce the sound provided by the device to that selected by the user.

It will be appreciated that there is a direct relationship between the dimensions and forms of the ridges on the device and the sound produced by the device. This should be related to the sped with which the sports implement will be optimally swung through the air in a stroke playing arc. Thus, the exact dimensions of the sound producing formations on the device will be selected in accordance with the sport to be played. Clearly, it will be possible to select different configurations of device for different levels of the sport such that a junior player may select one type of ridge configuration whereas a more advanced player would select another type of ridge configuration. The actual ridge configurations can be determined either analytically or empirically. It may in some instances be preferable for obtaining optimum sound for the ridges to be non-continuous.

It is submitted that a device in accordance with the preceding description has substantial advantages. Firstly, the device will operate equally well on the backhand or forehand strokes, or swing and backswing strokes, which most sports implements are required to perform. Thus, an audio feedback will be obtained with both such stroke directions. Likewise, the orientation of the device will not greatly effect the sound produced by the device. Thus, if the racket or club is twisted on its axis, the device will still produce an audible sound as it is swung, thereby providing an accurate feedback of swing speed without confusing that information with sports implement orientation which can also vary during play. Prior art devices have generally comprised a whistle or the like which require airflow to pass therethrough and these devices require the sports implement to be in a particular orientation in order to satisfactorily produce the required sound. Confusion thus results with prior art devices where the sports implement is being swung at the correct pace but at the incorrect orientation and the user is unsure of why the device is not producing the audible feedback sound as it should be. This will not be the case with the device of the present invention.

It will be appreciated that the audio chacteristics of the device can be varied by varying the length of the device. Thus, advance players who swing their sports implement at relatively high speeds will require only a relatively short audio feedback device in order to obtain a satisfactory audio feedback. More junior players would generally select a longer device.

It may in some circumstances be preferable to manufacture the device from a relatively soft but resilient plastics material in order that the device serves as a impact absorbing material for the sports implement. This can have safety advantages since the material will absorb some of the impact of the ball striking the sports implement where the device is located on the ball striking surface and the ball thus struck will travel less far. Also, a sports implement fitted with an audio feedback device will provide warning to players playing alongside the user of the device and those players will be warned when the sports implement is brought into close proximity to them. Thus, the risk of accidental injury as a result of player partners being in too close a proximity to the back swing or follow through of their player partners will be reduced as the players will be warned when the sports implement is in close proximity to them.

Finally, it is to be understood that various alternations, modifications and/or additions may be introduced into the constructions and arrangements of parts previously described without departing from the spirit or ambit of the invention.

What is claimed is:

1. An audio feedback device for use with a sports implement having an outer surface and a contact surface for contacting a sports ball, comprising:

an elongate flexible tubular sleeve having a predetermined length, an outer surface and an inner surface sized to fit directly onto the outer surface of the sports implement, said sleeve defining a boundary of the contact surface when positioned on the sports implement so that said contact surface is free to contact a sports ball without interference from said sleeve;

ridge means, extending along the length of said sleeve outer surface for creating an audible sound when the sport implement is swung through the air; and said sleeve has a gap along its entire length to permit attachment of said sleeve to the sports implement, the sound being indicative of the speed at which the sports implement is swung through the air.

2. The device of claim 1 wherein the body is sufficiently flexible for permitting a user to orient the ridge means in a helical pattern to adjust the volume of sound produced.

3. The device of claim 1 wherein the ridge means includes a plurality of ridges having a height between 1 to 1.5 mm, and spaced between 1 to 1.5 mm apart.

4. The device of claim 1 wherein the sleeve has a wall thickness between the inner surface and the outer surface of about 1 to 1.5 mm.

5. The device of claim 1 wherein the ridge means includes a plurality of ridges having heights of between 2 and 3 mm, and spaced between 2 to 3 mm apart.

6. The device of claim 1 wherein said sleeve has a wall thickness between the inner surface and the outer surface of about 2 to 3 mm.

7. The sports implement of claim 1 wherein the sports implement is a tennis racket having a head and a handle secured to the head, the head including spaced-apart side frame sections extending generally parallel to the handle.

8. The sports implement of claim 7 wherein each of the spaced-apart side frame sections has said sleeve mounted thereon.

9. The sports implement of claim 1 wherein the sports implement is an elongated baseball bat having a handle end and said ball contact surface remote from said handle end.

* * * * *